US006216877B1

(12) United States Patent
Lindström

(10) Patent No.: US 6,216,877 B1
(45) Date of Patent: Apr. 17, 2001

(54) SCREEN PANEL AND METHOD OF ITS MANUFACTURE

(75) Inventor: Alf Lindström, Sundsbruk (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/242,158

(22) PCT Filed: Jun. 3, 1997

(86) PCT No.: PCT/SE97/00958

§ 371 Date: Feb. 9, 1999

§ 102(e) Date: Feb. 9, 1999

(87) PCT Pub. No.: WO98/06893

PCT Pub. Date: Feb. 19, 1998

(30) Foreign Application Priority Data

Aug. 9, 1996 (SE) ..... 9602953

(51) Int. Cl.[7] ..... B07B 1/49; B23P 15/16

(52) U.S. Cl. ..... 209/397; 209/273; 210/498; 29/896.6

(58) Field of Search ..... 209/270, 273, 209/397, 399; 210/415, 497.01, 498; 29/896.6, 896.61, 896.62

(56) References Cited

U.S. PATENT DOCUMENTS

| | | | | |
|---|---|---|---|---|
| 4,374,729 | | 2/1983 | Frykhult | 210/402 X |
| 4,795,560 | * | 1/1989 | Chupka et al. | 209/397 X |
| 4,986,900 | * | 1/1991 | Mason | 209/273 X |
| 5,064,537 | * | 11/1991 | Chupka et al. | 210/415 X |

FOREIGN PATENT DOCUMENTS

| | | |
|---|---|---|
| 0 287 267 A2 | 10/1988 | (EP) . |
| 0 357 382 A2 | 3/1990 | (EP) . |

* cited by examiner

*Primary Examiner*—Tuan N. Nguyen
(74) *Attorney, Agent, or Firm*—Lerner, David, Littenberg, Krumholz & Mentlik, LLP

(57) ABSTRACT

Screen panels are disclosed for the screening of fibrous material. The screen panels are one-piece screen panels which can then be incorporated into a cylindrical screen jacket without the use of welding. The screen panels include a plurality of apertures for the fibrous material and are made from a wear-resistant material. Methods for producing these screen panels are also disclosed.

7 Claims, 1 Drawing Sheet

SCREEN PANEL AND METHOD OF ITS MANUFACTURE

This invention relates to a screen device for screening fiber material and to a method of manufacturing this screen device.

The screening of fiber material, such as fiber suspensions of cellulosic material has the object to separate coarse particles in the form of shives, fiber bundles or other impurities from the fiber material. The screening normally is carried out in screen devices comprising a screen cylinder, which is stationary or rotary. The screen cylinder is provided with holes or slots, through which the fibers, but not the impurities, can pass.

Screen cylinders of this kind normally are manufactured by drilling holes or milling slots in a metal sheet which then is formed to a cylinder. For obtaining an open area as large as possible, i.e. the portion of the screen cylinder surface, which is perforated, the holes or slots must be arranged in dense relationship while at the same time the strength of the cylinder must be maintained. This requires great precision work.

Especially at the manufacture of slotted cylinders, which in certain cases are more advantageous than cylinders with drilled holes, difficulties arise concerning the strength, because the material remaining between the slots will be thin. The slots, therefore, must be milled short and at a certain distance from each other, which implies a restriction of the open area.

One way of solving this problem is to form the cylinder of a great number of bars, which are kept in place by ring-shaped ledges. This is, however, a complicated and expensive way of manufacturing a screen cylinder. It is also difficult to achieve a uniform slot width across the entire cylinder.

This problem is solved according to the invention by forming the screen device of a number of screen panels, which together form a screen cylinder. The screen panels are manufactured individually by forming them in one piece, whereafter the screen apertures are formed in the panels. A plurality of panels are thereafter assembled to a screen cylinder. The characterizing features of the invention are apparent from the attached claims.

The forming of the panels can be carried out by casting, extrusion, compression moulding or the like of a material, which consists of a suitable metal alloy or ceramic material, for example aluminium oxide. The material should be wear-resisting and un-weldable. After their forming, the panels are provided in a suitable way with screen apertures in the form of holes or slots. This can be brought about for example, by water-, laser- or electron-cutting. For improving the surfaces of the screen apertures still more, they can be polished, for example by wet abrasive polishing.

The method is described in greater detail in the following, with reference to the accompanying Figures illustrating an embodiment of the invention.

FIG. 1 shows a screen panel according to the invention.

FIG. 2 is a cross-section through the screen panel according to II—II in FIG. 1.

The screen panel shown in FIG. 1 is a portion of the jacket of a screen cylinder. By assembling a plurality of screen panels, a screen cylinder is formed. Each panel 1 preferably is formed by casting according to the shell moulding method. The casting mould has the form desired of the final panel. In FIG. 2 the profile of the screen surface is shown, comprising deep axial channels 2 on one side and grooves 3 on the other side.

After the casting, the panels are provided with screen apertures in the form of holes or slots 4 in the channels 2.

The screen apertures are cut with high precision by water-, laser- or electron-cutting, whereby a holed diameter or slot width of 0,1–1 mm can be achieved. The surface of the screen apertures can be improved by polishing, for example by wet abrasive polishing. By forcing a suspension consisting of more or less wearing particles, for example olivine sand, through the screen apertures, a burring and polishing effect is obtained. In order to increase this effect, the suspension preferably is flushed repeatedly and in changing direction through the apertures. It can thereby even be possible to modify the size of the screen apertures.

The invention implies that a slotted screen cylinder can be manufactured with high dimensional accuracy and with a large open area without deteriorating the strength. The screen panels are assembled in a suitable way to a cylinder, for example by welding, screw joint or the like by means of support rings holding the panels together.

A screen cylinder manufactured of screen panels according to the invention can be given high precision and great strength. It is easy to mount and can be formed of very wear-resisting material yielding a long service life. Due to the high precision of the apertures, the screening result can be improved.

The invention, of course, is not restricted to the embodiment described above, but can be varied within the scope of the invention idea.

What is claimed is:

1. A screen panel for the screening of fibrous material, said screen panel comprising a one piece screen panel of wear-resistant material adapted for incorporation into a cylindrical screen jacket without use of welding, said screen panel including a plurality of apertures for said fibrous material, wherein said screen panel includes a first surface and a second surface, said first surface of said screen panel including a plurality of axially extending channels including a bottom and said second surface of said screen panel including a plurality of grooves, and wherein said plurality of apertures are formed as longitudinally extending slots and are disposed at said bottoms of said plurality of axially extending channels.

2. The screen panel of claim 1 wherein said plurality of apertures comprise an opening of from about 0.1 to 1 mm.

3. The screen panel of claim 1 wherein said screen panel is produced by casting of metal alloy.

4. A method for manufacturing a screen panel having a first and second surface for incorporation into a cylindrical screen jacket without the use of welding for the screening of fibrous material, said method comprising forming said screen panel in one piece from a wear-resistant material, providing said screen panel with a plurality of apertures formed as longitudinally extending slots, forming a plurality of axially extending channels including a bottom on said first surface of said screen panel, and forming a plurality of grooves on said second surface of said screen panel, said plurality of apertures being disposed at said bottoms of said plurality of axially extending channels.

5. The method of claim 4 wherein said forming of said screen panel comprises a process selected from the group consisting of casting, extrusion and compression molding.

6. The method of claim 4 wherein said providing of said screen panel with a plurality of apertures comprises a procedure selected from the group consisting of water, laser and electron cutting processes.

7. The method of claim 4 including improving the surfaces of said apertures by wet abrasive polishing.

* * * * *

UNITED STATES PATENT AND TRADEMARK OFFICE

CERTIFICATE OF CORRECTION

PATENT NO. : 6,216,877 B1
DATED : April 17, 2001
INVENTOR(S) : Lindström

It is certified that error appears in the above-identified patent and that said Letters Patent is hereby corrected as shown below:

Delete the specification and substitute the attached specification.

Signed and Sealed this

Ninth Day of December, 2003

JAMES E. ROGAN
*Director of the United States Patent and Trademark Office*

SCREEN PANEL AND METHOD OF ITS MANUFACTURE

FIELD OF THE INVENTION

The present invention relates to a screen device for screening fibrous material. More particularly, the present invention relates to a method of manufacturing such a screen device.

BACKGROUND OF THE INVENTION

The screening of fibrous material, such as fiber suspensions of cellulosic material, has the object of separating coarse particles in the form of shives, fiber bundles or other impurities from the fibrous material. The screening is normally carried out in screen devices comprising a screen cylinder, which may be stationary or rotary. The screen cylinder is provided with holes or slots, through which the fibers, but not the impurities, can pass.

Screen cylinders of this type are normally manufactured by drilling holes or milling slots in a metal sheet which then is formed into a cylinder. For obtaining an open area which is as large as possible, i.e. the portion of the screen cylinder surface, which is perforated, the holes or slots must be arranged in a rather dense relationship, while at the same time the strength of the cylinder must be maintained. This requires great precision.

Particularly during the manufacture of slotted cylinders, which in certain cases are more advantageous than cylinders with drilled holes, difficulties arise concerning the strength, because the material remaining between the slots will now be extremely thin. The slots, therefore, must only be milled short and at a certain distance form each other, therefore resulting in a restriction to the area which is open.

One way of solving this problem is to form the cylinder from a great number of bars, which are kept in place by ring-shaped ledges. This is, however, a complicated and expensive way to manufacture a screen cylinder. It is also difficult to achieve a uniform slot width across the entire cylinder.

SUMMARY OF THE INVENTION

In accordance with the present invention, these and other objects have now been realized by the discovery of a screen panel for the screening of fibrous material, the screen panel comprising a one-piece screen panel adapted for incorporation into a cylindrical screen jacket without use of welding, the screen panel including a plurality of apertures for the fibrous material and comprising a wear-resistant material. In a preferred embodiment, the screen panel includes a first surface and a second surface, the first surface of the screen panel including a plurality of axially extending channels including a bottom and the second surface of the screen panel including a plurality of grooves, the plurality of apertures being disposed at the bottom of the plurality of axially extending channels.

In accordance with one embodiment of the screen panel of the present invention, the plurality of apertures comprises an opening of from about 0.1 to 1 mm.

In accordance with another embodiment of the screen panel of the present invention, the plurality of apertures are formed as longitudinally extending slots.

In accordance with the present invention, a method has also been discovered for manufacturing a screen panel for incorporation into a cylindrical screen jacket without the use of welding for the screening of fibrous material, the method comprising forming the screen panel in one piece from a wear-resistant material, and providing the screen panel with a plurality of apertures. In a preferred embodiment, forming of the screen panel comprises a process such as casting, extrusion or compression molding.

In accordance with one embodiment of the method of the present invention, providing the screen panel with a plurality of apertures comprises a procedure such as water-, laser- or electron-cutting processes.

In accordance with another embodiment of the method of the present invention, the screen panel includes a first surface and a second surface, the method including forming a plurality of axially extending channels including a bottom on the first surface of the screen panel and forming a plurality of grooves on the second surface of the screen panel, the plurality of apertures being disposed at the bottoms of the plurality of axially extending channels.

In accordance with another embodiment of the method of the present invention, the method includes improving the surfaces of the apertures by wet abrasive polishing.

According to the present invention, the problems of the prior art are overcome by forming the screen device from a number of screen panels, which together form a screen cylinder. The screen panels are manufactured individually by forming them in one piece, whereafter the screen apertures are formed in the panels. A plurality of panels are thereafter assembled into a screen cylinder.

The forming of the panels of the present invention can be carried out by casting, extrusion, compression molding or the like of a material, which consists of a suitable metal alloy or ceramic material, for example aluminum oxide. The material should be wear-resistant and un-weldable. After their formation, the panels are provided, in a suitable manner, with screen apertures in the form of holes or slots. This can be accomplished, for example, by water-, laser- or electron-cutting. For further improving the surfaces of the screen apertures, they can be polished, for example, by wet abrasive polishing.

BRIEF DESCRIPTION OF THE DRAWINGS

The present invention is described in greater detail in the following detailed description which, in turn, refers to the accompanying Figures illustrating an embodiment of the invention wherein.

DETAILED DESCRIPTION

Figure 1:
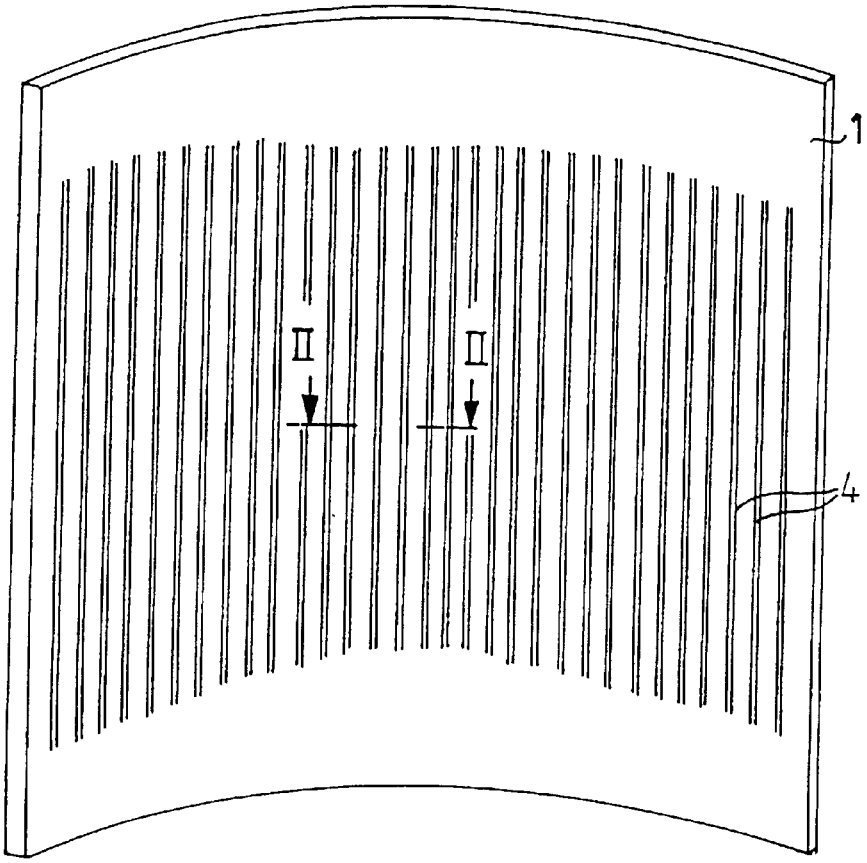
FIG. 1 is a front, perspective view of a screen panel according to the present invention.
Figure 2:
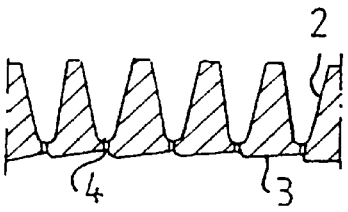
FIG. 2 is a side, elevational, cross-sectional view of the screen panel according to FIG. 1 taken along line II—II thereof.

The screen panel shown in FIG. 1 is a portion of the jacket of a screen cylinder. By assembling a plurality of these screen panels, a screen cylinder is formed. Each panel 1 is preferably formed by casting according to the shell molding method. The casting mold has the desired form of the final panel. In FIG. 2 the profile of the screen surface is shown, comprising deep axial channels 2 on one side and grooves 3 on the other side.

After casting, the panels are provided with screen apertures in the form of holes or slots 4 in the channels 2. The screen apertures are cut with high precision by water-, laser- or electron-cutting, whereby a holed diameter or slot width of from about 0.1 to 1 mm can be achieved. The surface of the screen apertures can be improved by polishing, for example, by wet abrasive polishing. By forcing a suspension consisting of particles which can create a desired degree of wear, for example, olivine sand, through the screen apertures, a burring and polishing effect is obtained. In order to increase this effect, the suspension is preferably flushed repeatedly, and in a changing direction, through the apertures. It can in this manner even be possible to modify the size of the screen apertures.

The present invention makes it possible for a slotted screen cylinder to be manufactured with high dimensional accuracy and with a large open area, without deteriorating its strength. The screen panels are assembled in a suitable manner into a cylinder, for example, by welding, screw joint or the like, by means of support rings holding the panels together.

A screen cylinder manufactured from screen panels according to the present invention can possess high precision and great strength. It is easy to mount and can be formed of very wear-resistant material, yielding a long service life. Due to the high precision of the apertures, the screening resulting therefrom can be improved.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A screen panel for the screening of fibrous material, said screen panel comprising a one piece screen panel of wear—resistant material adapted for incorporation into a cylindrical screen jacket without use of welding, said screen panel including a plurality of apertures for said fibrous material, wherein said screen panel includes a first surface and a second surface, said first surface of said screen panel including a plurality of axially extending channels including a bottom and said second surface of said screen panel including a plurality of grooves, and wherein said plurality of apertures are formed as longitudinally extending slots and are disposed at said bottoms of said plurality of axially extending channels.

2. The screen panel of claim 1 wherein said plurality of apertures comprise an opening of from about 0.1 to 1 mm.

3. The screen panel of claim 1 wherein said screen panel is produced by casting of metal alloy.

4. A method for manufacturing a screen panel having a first and second surface for incorporation into a cylindrical screen jacket without the use of welding for the screening of fibrous material, said method comprising forming said screen panel in one piece from a wear-resistant material, providing said screen panel with a plurality of apertures formed as longitudinally extending slots, forming a plurality of axially extending channels including a bottom on said first surface of said screen panel, and forming a plurality of grooves on said second surface of said screen panel, said plurality of apertures being disposed at said bottoms of said plurality of axially extending channels.

5. The method of claim 4 wherein said forming of said screen panel comprises a process selected from the group consisting of casting, extrusion and compression molding.

6. The method of claim 4 wherein said providing of said screen panel with a plurality of apertures comprises a procedure selected from the group consisting of water, laser and electron cutting processes.

7. The method of claim 4 including improving the surfaces of said apertures by wet abrasive polishing.

* * * * *